United States Patent [19]

Perrine et al.

[11] 4,038,708

[45] Aug. 2, 1977

[54] COMMODE WATER CONSERVATION APPARATUS

[76] Inventors: Paul M. Perrine, P.O. Box 270; Vincent C. Janes, Box 222 R. No. 1, both of Aurora, Ind. 47001; James A. Cassera, 679 Funston Ave., San Luis Obispo, Calif. 93401

[21] Appl. No.: 714,779

[22] Filed: Aug. 16, 1976

[51] Int. Cl.[2] ..... E03D 1/34; E03D 5/02

[52] U.S. Cl. ..... 4/67 A; 4/56; 4/34; 4/52; 4/18 R

[58] Field of Search ..... 4/67 A, 67 R, 56, 34, 4/57 R, 37, 62, 18 R, 1, 52, 53, DIG. 1

[56] References Cited

U.S. PATENT DOCUMENTS

| | | | |
|---|---|---|---|
| 2,773,268 | 12/1956 | Hurko et al. | 4/63 X |
| 3,003,156 | 10/1961 | Alexander | 4/63 X |
| 3,026,536 | 3/1962 | Wood | 4/67 A |
| 3,773,063 | 11/1973 | Roosa | 4/44 |
| 3,885,253 | 5/1975 | Overbey | 4/67 A |
| 3,969,774 | 7/1976 | Karlsson | 4/41 |

*Primary Examiner*—Henry K. Artis

*Attorney, Agent, or Firm*—Melville, Strasser, Foster & Hoffman

[57] ABSTRACT

Apparatus for selectively conserving water used in association with a commode flush tank is disclosed. The apparatus comprises a generally rectangular plate having ratchet means for wedging the plate between two opposed walls of the tank. The plate further includes a series of longitudinally disposed circular apertures for carrying an elongated stem member downwardly into the tank. The stem member, which slidably receives an elongated float, is carried by the plate so as to maintain the float disposed relative to the buoyant outlet valve of the flush tank. Whereby upon only partial emptying of the tank in response to operating the flush lever, the float contacts the buoyant valve to effect premature closure thereof. In another embodiment, the stem and float may be disposed to one side of the buoyant valve such that a transversely extending retainer clip carried by the float applies a vertical uniform pressure to the top of the buoyant valve in order to achieve premature closure.

11 Claims, 7 Drawing Figures

COMMODE WATER CONSERVATION APPARATUS

BACKGROUND OF THE INVENTION

The apparatus of the present invention relates to devices of the type useful for conserving natural resources and, specifically, of the type useful for conserving water. More particularly, the apparatus of the present invention relates to a novel improvement in accessories for commode flush tanks whereby, in addition to obtaining a complete flush thereof, it is possible to selectively effect a partial flush to conserve on the use of water.

Conventional commode flush tanks are typically arranged to hold a predetermined amount of water, defined by a water line in the tank, and to dispense substantially its entire content of water each time the commode is flushed. However, in many situations less than a complete flush would be sufficient to adequately drain the commode and, in these situations, a complete flush would be largely wasteful of an often overlooked precious resource. It would therefore be highly desirable to provide means whereby the amount of flushing water released by the flush tank of a commode could be selectively controlled dependent upon the particular circumstances at hand.

To this end, there is known in the prior art various devices which enable the release of different amounts of water from the flush tank at the control of the commode user. Typically, the control is achieved through utilization of means which reduce the unseated freedom of the conventional buoyant outlet valve during the flushing operation to obtain a more prompt closing thereof before the tank is completely emptied. Prior art devices of this general type, which frequently employ floating members to contact the outlet valve to effect premature closure of the tank, are exemplified by the apparatus disclosed in U.S. Pat. No. 3,345,648 issued to M.J. Rafferty, U.S. Pat. No. 3,561,016 issued to B. F. Reynolds, and U.S. Pat. No. 2,754,521 issued to F. Marcum.

Although, in this regard, known prior art devices have been satisfactory to some extent, they have generally exhibited certain deficiencies inhibiting their widespread adoption and use. Primarily, known prior art devices are generally relatively complex structures which are expensive to manufacture and sell and, quite significantly, are not easily adaptable for use with existing and variously configured commode constructions. In addition, the operating characteristics of known prior art devices are adjustable in only a limited degree, further reducing their adaptability and therefore their desirability.

SUMMARY OF THE INVENTION

It is a basic object of the present invention to provide improved means for use in combination with a conventional commode flush tank to promote the conservation of water in connection with the use of the tank.

More particularly, it is an object of the invention to provide improved apparatus, adaptable for use with existing and variously configured commode flush tank constructions, for selectively enabling the premature closing of the flush tank outlet valve to achieve only a partial emptying of the tank during a flushing operation.

Further objects of the present invention include the provision of apparatus of the foregoing type which may be conveniently and easily retrofitted to existing commode flush tanks, which may be inexpensively manufactured and sold, which are simple in construction and highly reliable in use and which may be adjusted to provide various operating characteristics as desired.

In accordance with these and other useful objects there is provided an accessory for use with a conventional commode flush tank which comprises a generally rectangular, two-piece support plate, an elongated stem member extending downwardly from the plate into the tank and an float slidably received by the stem member.

One piece of the rectangular support plate comprises a rectangular adjusting bar having a plurality of centrally disposed circular apertures extending longitudinally thereof and having a pair of ratchet strips disposed on either side of the apertures, each of the ratchet strips comprising a plurality of transversely extending inclined teeth. The other piece of the support plate comprises a lock bar slidably associated with, and at least partially overlying, the adjusting bar and includes a pair of pawls disposed for engaging the inclined teeth of the ratchet strips. This arrangement allows for relatively easy sliding displacement of the lock bar relative to the adjusting bar in one direction and relatively difficult sliding displacement thereof in the opposite direction to facilitate wedging the support plate between two opposed walls of the flush tank.

An elongated stem member is securely carried by the support plate in association with one of its circular apertures so as to extend downwardly into the tank and slidably receive an adjustable elongated float. Depending upon the particular commode flush tank design, the stem and float may be positioned generally over th buoyant outlet valve of the tank or, alternatively, may be disposed to one side thereof. In the latter case, the elongated float carries a retainer clip having a pair of transversely extending arms disposed over the buoyant outlet valve.

In use, when the flush tank is full, the float will be maintained in a position spaced upwardly of the buoyant outlet valve. Upon initiating a flushing operation by operating the tank flush lever, the float will descent toward the buoyant outlet valve as the water level decreases. At some predetermined water level, the float or clip contacts the valve causing it to prematurely close before the tank has fully emptied. If desired, a complete flush of the tank can be effected by simply maintaining the flush lever depressed, thereby overriding the operation of the float.

BRIEF DESCRIPTION OF THE DRAWINGS

FIG. 5 is an exploded perspection view showing the various components of the apparatus of the present invention.

DESCRIPTION OF THE PREFERRED EMBODIMENTS

Figure 1:
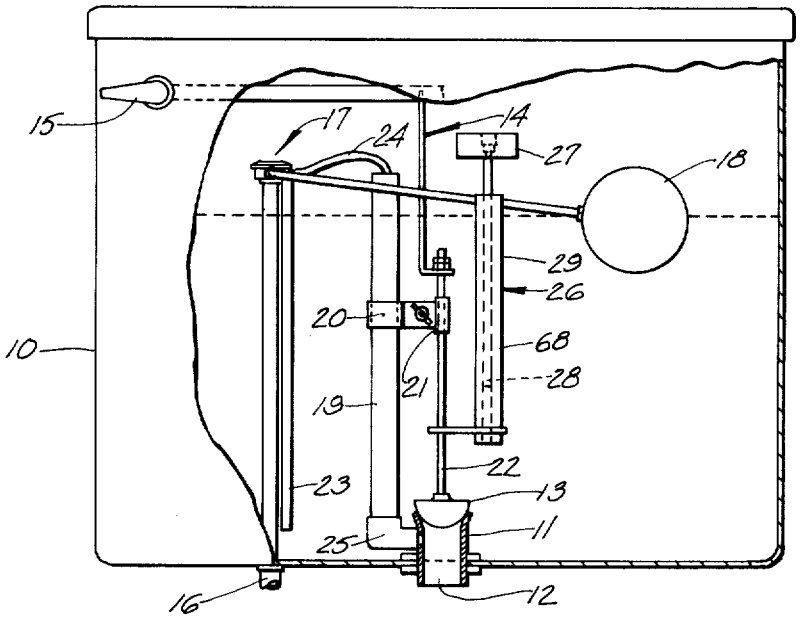
FIG. 1 is an elevational view showing the apparatus of the present invention in association with one type of a conventional flush tank which is filled to its normal level prior to use.
Figure 2:
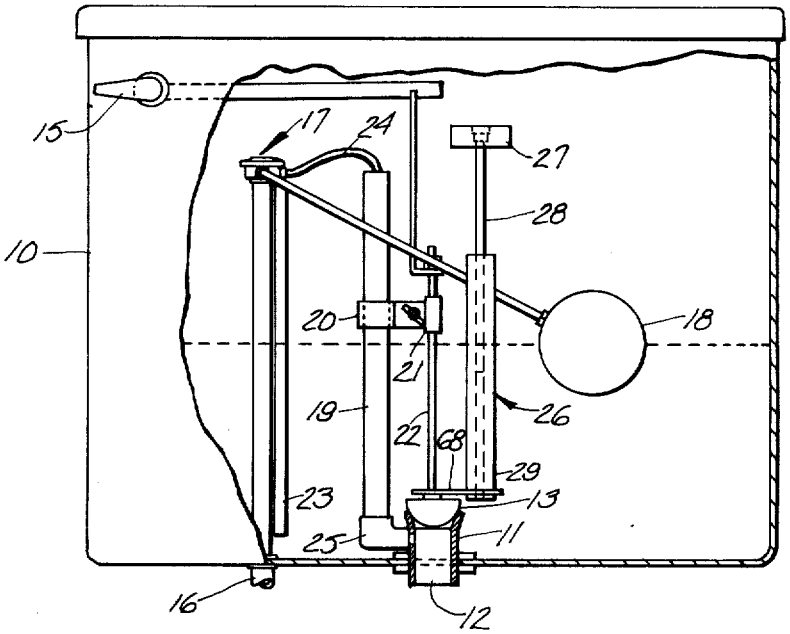
FIG. 2 is an elevational view similar to FIG. 1 showing the apparatus of the present invention contacting the buoyant outlet valve of the flush tank shown in FIG. 1 to effect premature closure thereof.

Referring now to the drawings, and particularly to FIGS. 1 and 2, there is shown the apparatus of the present invention in operative association with a conventional rigid stem type flush tank 10. Typically, flush tank 10 will include a fitting 11 defining an outlet passage 12 through which flushing water passes from the tank. A hollow buoyant valve 13, typically made of rubber, is connected through a series of linkages, generally indicated at 14, to a manually operable flush lever 15 and provides a facility for controlling the outlet passage 12. Water is admitted to the tank 10 through inlet 16 under the control of valvular means, generally indicated at 17, which in turn, is controlled in a well known manner by float 18. Tank 10 will also typically include an overflow pipe 19 communicating with outlet passage 12 below buoyant valve 13 to permit the escape of water from the tank 10, when, for some reason, the water level rises excessively. A bracket 20 may be connected to the overflow pipe 19 and includes means at 21 to vertically and slidably receive arm 22 of linkage 14 to facilitate seating of valve 13 in fitting 11. The out put of valvular means 17 is connected to a pair of water discharge conduits 23 and 24. Whenever float 18 causes valvular means 17 to open, water will be passed from inlet 16 through valvular means 17 and discharge 23 to fill the tank 10. Also, simultaneously, a slight flow of water will be channeled directly to the outlet passage 12 through circuit 24 and overflow pipe 19.

In use, the tank 10 is typically filled with water to a level defined by a waterline marking within the tank. Upon operating lever 15 linkage means 14 will vertically raise valve 13 which, even though lever 15 has been released, will remain unseated due to its inherent buoyancy. Consequently, flushing water will be discharged through outlet passage 12 lowering the water level in the tank. Soon after the water level in the tank begins receding, float 18 operates valvular means 17 which allows water to enter tank 10 through conduit 23 as well as providing a direct although small flow of water to outlet passage 12 through a conduit 24 and overflow pipe 19. The water in the tank 10, as well as the water entering through inlet 16, discharges through outlet passage 12 until valve 13 loses its buoyancy and reseats closing outlet passage 12. At this time, the tank has been substantially completely emptied. Water will thereafter continue entering inlet 16 and will fill tank 10 through conduit 23 until the water level has risen to a point where float 18 closes valvular means 17. Subsequent flushing operations will be accomplished in an identical sequence.

Figure 3:
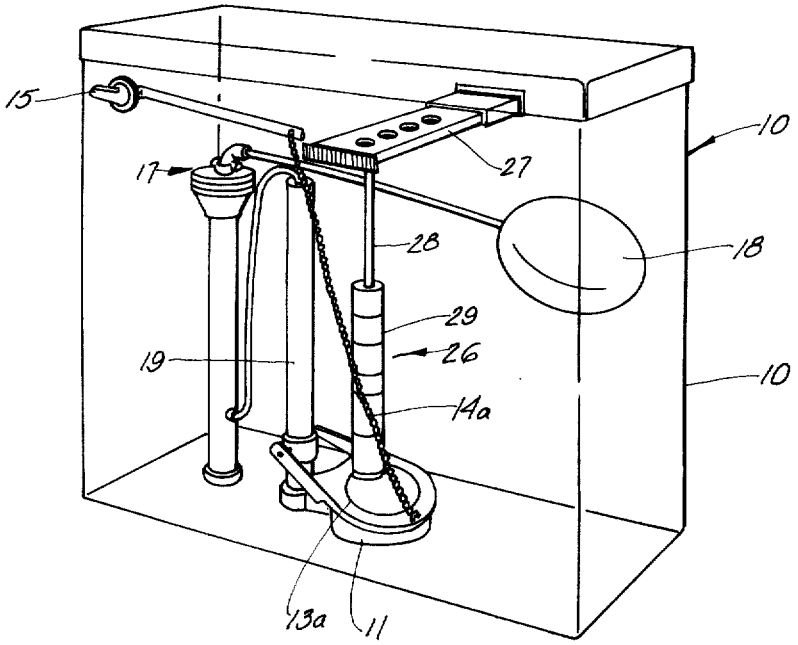
FIG. 3 is a perspective view showing the apparatus of the present invention in association with another flush tank construction and wherein the tank's outlet valve is being contacted
Figure 4:
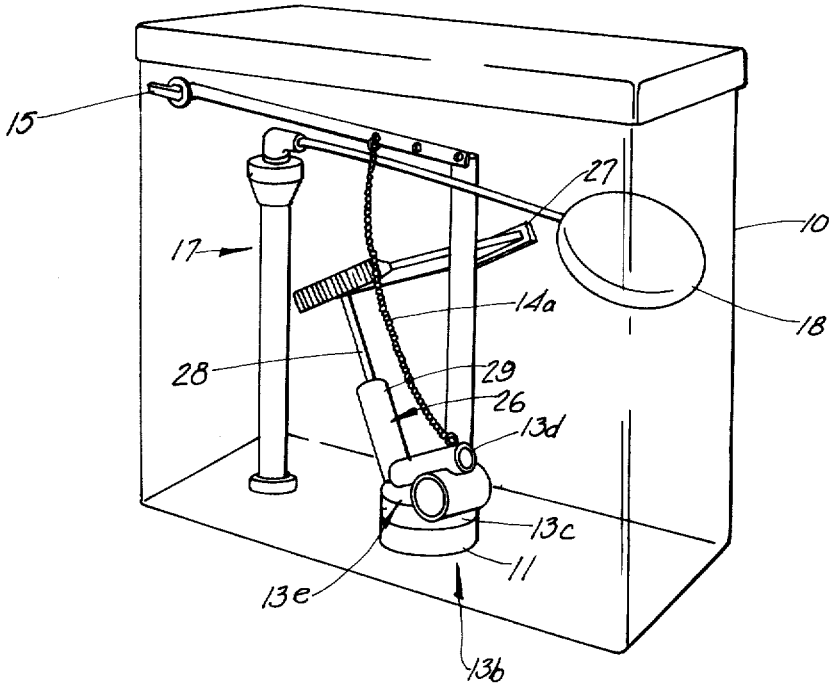
FIG. 4 is a perspective view similar to FIG. 3 but showing the adaptation of the apparatus of the present invention to yet another flush tank construction.
Figure 2:
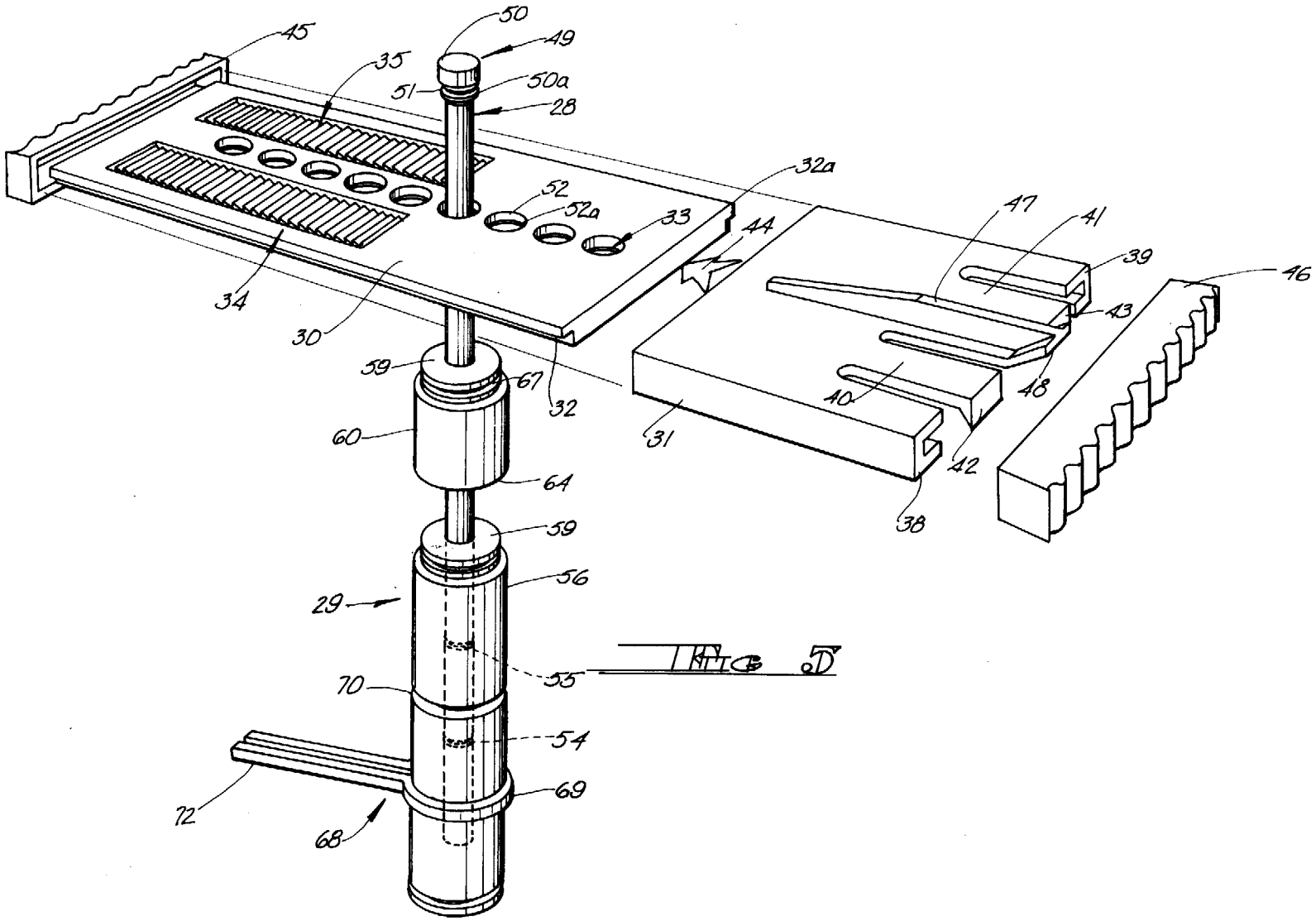

Although the flush tank 10 was described above in terms of a specific embodiment, it will be understood that such was done for exemplary purposes only and is not intended to be limiting. In this regard, numerous well known modifications may be made to the structure of the flush tank shown in FIGS. 1 to effect premature closure thereof. and 2 without substantially altering its operating characteristics which are representative of virtually all such flush tanks in present use. For example, two other well known flush tank constructions are shown in FIGS. 3 and 4. Although operationally equivalent to the flush tank 10 shown in FIGS. 1 and 2, the flush tanks shown in FIGS. 3 and 4 utilize different outlet valve structures as well as modified valve operating mechanisms. In this regard, the tank 10 shown in FIG. 3 employs an outlet buoyant valve 13*a* commonly referred to as a "flapper valve " to control the tank's outlet passage 12. The valve 13*a* is typically a hollow rubber structure seatable in fitting 11 and is hingedly secured at the lower end of overflow pipe 19 as at 25*a*. On the other hand, the outlet valve 13*b* shown in FIG. 4 is commonly referred to as an American Standard Flush Valve and typically includes a rubber stopper 13*c* seatable in fitting 11 and a self-draining counterweight 13*d*. Valves of this latter type are fully described in U.S. Pat. No. 2,773, 268 issued on Dec. 11, 1956 to B. Hurko et al. Moreover, both flush tank constructions shown in FIGS. 3 and 4 utilize a chain 14*a* to connect valves 13*a* and 13*b* to the horizontal arm of linkage means 14 instead of the rigid vertical member shown in FIGS. 1 and 2. However, even though the outlet valve structures are somewhat different, it will nevertheless be recognized that the basic operational features of the tanks shown in FIGS. 3 and 4 are substantially identical to that previously described herein with regard to tank 10 shown in FIGS. 1 and 2. And, significantly, it will be appeciated that valves 13*a* and 13*b* exhibit buoyancy characteristics similar to that described with respect to valve 13. Modifications in the structure of flush tank 10 of the foregoing type are intended to be comprehended by the present invention.

The water conserving apparatus of the present invention is generally shown in FIGS. 1 and 2 at 26. Basically, the water conserving apparatus comprises an adjustable supporting plate 27 horizontally wedged between two opposed walls of the tank 10. An elongated stem 28 is carried by the plate 27 downwardly into tank 10 and disposed to one side of valve 13. The stem 28 slidably receives a float 29 which carries a bifurcated retainer clip 68 having a pair of transversely extending arms positioned over valve 13 and on either side of arm 22.

As shown in FIG. 1, the supporting plate 27 is vertically disposed within the tank 10 so that, when the tank is full, the float 29 is spaced from valve 13 by a predetermined amount. As the water level recedes after the tank 10 has been flushed, the float 29 will vertically descend until, at some point, the clip 68 contacts the top surface of valve 13 as shown in FIG. 2. At this point, the clip 68 exerts a vertical uniform pressure on the top of valve 13 causing it to prematurely seat thereby closing outlet passage 12 only after approximately half of the tank has emptied. It will be recognized that, if a full flush is desired, this may readily be accomplished by simply holding lever 15 depressed and thereby manually overriding the effect of the float 29 and clip 68 until the entire contents of the tank 10 has been discharged.

In the flush tank embodiments shown in FIGS. 3 and 4 the water conserving apparatus 26 may be used without the retainer clip 68, premature closing of valves 13*a* and 13*b* being effected by direct contact with float 29. Therefore, in FIG. 3 the stem 28 is positioned relative to plate 27 so that the float 29 is maintained vertically disposed over valve 13*a*. As the water level in the tank recedes the float 29, at a predetermined point, will directly contact the valve 13*a* causing it to prematurely close. In FIG. 4, due to the structure of valve 13*b*, it is necessary to wedge plate 27 between the tank walls so that it is slightly offset from the horizontal as shown. The stem 28 and float 29 will therefore descend into the tank at an angle offset from vertical to contact the rubber stopper 13*c* of the valve 13*b* at 13*c* to effect premature closure thereof.

As described above, the water conserving apparatus 26 is adaptable for use in association with variously configured flush tanks including a number not specifically shown herein. This vertically results from various adjustment features which render the apparatus 26 substantially universal and which are discussed in more detail below.

Figures 6, 7:
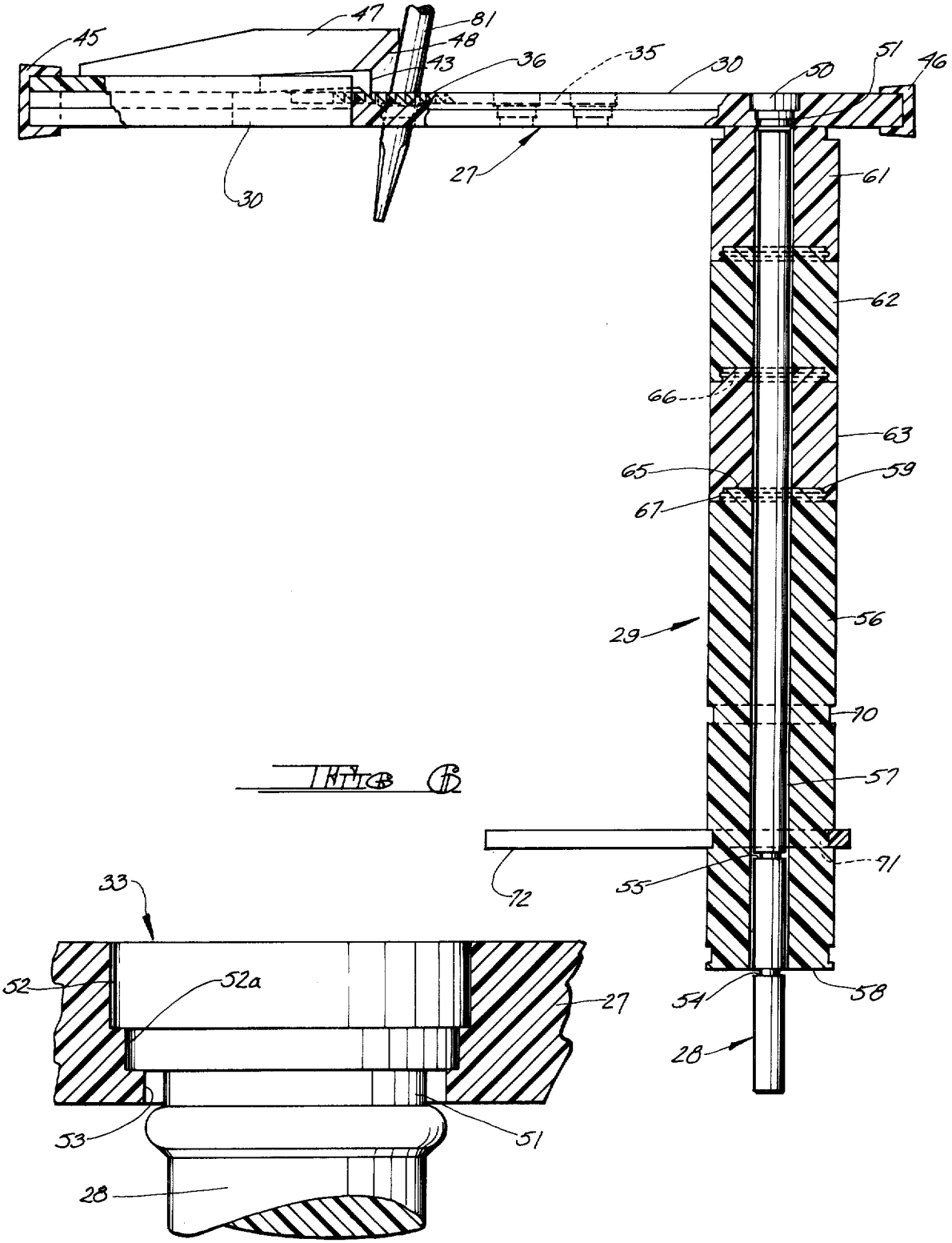
FIG. 6 is a side elevation in partial section showing the various components of the apparatus of the present invention in assembled form.
FIG. 7 is an enlarged side elevation in partial section showing the connection between the supporting plate and the stem.

Accordingly, the construction of the water conserving apparatus 26 is shown in detail in FIGS. 5 and 6. It will be seen that the supporting plate 27 comprises two slidably associated sections 30 and 31. Section 30 is a rectangular adjusting bar and includes a pair of longitudinal male slide members 32 and 32*a*. The adjusting bar 30 further includes a plurality of centrally disposed circular apertures 33 extending longitudinally thereof. A pair of rachet strips 34 and 35 are provided at one end of adjusting bar 30 on either side of the circular apertures 33. As best shown in FIG. 6, each of the ratchet strips 34 and 35 comprise a plurality of teeth 36 inclined at an angle of approsimtely 45°.

The supporting plate 27 further comprises a rectangular lock bar 31 which includes a pair of channel members 38 and 39 adapted to be slidably received by the male slide members 32 and 32*a* of the adjusting bar 30. The lock bar 31 further includes, inwardly of channel members 38 and 39, a pair of longitudinally extending arms 40 and 41 which carry a pair of transversely extending and substantially vertically disposed pawls 42 and 43.

To assemble the supporting plate 27, the lock bar 31 is slide over the adjusting bar 30 and in the direction indicated by arrow 44 wherein the pawls 42 and 43 will engage the ratchet strips 34 and 35. Due to the inclination of the teeth 36 of the ratchet strips 34 and 35 sliding displacement of the lock bar 31 relative to the adjusting bar 30 in this direction will be relatively easy. However, and for the same reasons, sliding displacement of lock bar 31 relative to adjusting bar 30 in the opposite direction will be extremely difficult. Therefore, one the lock bar 31 is appropriately positioned relative to the adjusting bar 30, relative movement between the bars in a direction opposite arrow 44 is extremely difficult.

The supporting plate 27 is installed within a flush tank by initially positioning the lock bar 31 on the adjusting bar 30 so that the entire length of plate 27 exceeds the length between the flush tank walls by approximately the longitudinal dimension of one of the teeth 36. The plate 27 may be lodged firmly to place between the tank walls by inserting a tool 81 or the like into one of the apertures 33 of bar 30 and prying the tool against lock bar 31. To provide a secure grip against the tank walls and more particularly to compensate for unparallel tank walls, a pair of serrated pads 45 and 46 may be provided at either end of the plate 27. It will be appreciated that pad 45 will be slightly greater in dimension than plate 46 to accommodate the larger dimension of lock bar 31 as distinguised from the dimension of the adjusting bar 30. Also, to facilitate the manual movement of the lock bar 31 relative to the adjusting bar 30, lock bar 31 may be provided with an upstanding member 47 which carries, near pawls 42 and 43, an inclined surface 48 adapted to engage the prying tool 81. Inclined surface 48 is therefore conveniently engageable for manually urging lock bar 31 slidingly along adjusting bar 30 in the direction of arrow 44.

After the supporting plate 27 is appropriately positioned in the tank 10, the stem 28 is inserted through an appropriate one of the circular apertures 33. The stem 28 includes a head portion 49 which comprises an upper relatively large circular portion 50, a lower relatively smaller stepped circular portion 50*a* and a groove 51. Correspondingly, each of the circular apertures 33 comprises a relatively large upper portion 52, a smaller lower portion 52*a* and a ring 53. By means of foregoing, a ring-groove type lock is provided wherein the supporting plate 27 snugly carries the stem 28.

It will be noted that the stem 28 includes, at its lower end, a pair of spaced annular grooves 54 and 55. Annular grooves 54 and 55 are provided for defining score lines at which the stem 28 may be broken relatively easily. This capability is provided for those instances in which a particular flush tank construction might require a shorter stem than ordinary.

The final step in the assembly of the water conserving apparatus 26 is to position the float 29 on the stem 28. The float 29, which is constructed of a material having a density less than that of water, comprises a main cylindrical portion 56 having a longitudinal aperture 57 extending therethrough for slidably receiving the stem 28. The cylindrical portion 56 has a flat surface at its lower end 58 and a disc shaped male mating means 59 of reduced diameter at its upper end. It will be appreciated that cylindrical portion 56 of the float 29 will, when the apparatus 26 is operatively installed in flush tank 10, float in the tank water and thereby position itself relative to stem 28 in accordance with the water level in the tank.

In cases where a float of longer length than cylindrical portion 56 is required, one or more cylindrical float extensions may be joined to cylindrical portion 56. In FIG. 5 one such extension 60 is shown above cylindrical portion 56 while, in FIG. 6, three such extensions 61, 62 and 63 are shown. Each of the cylindrical extensions 60–63 is of approximately the same diameter as cylindrical portion 56 but less than length therof, such as, for example, about one third the length thereof. In addition, each cylindrical extension 60–63 includes a disc shaped male mating means at one end thereof identical to the male mating means 59 of the cylindrical portion 56. Furthermore, each of the cylindrical extensions 60–63 includes a female mating means 64 at its end opposite its respective male mating means 50. Each of the female mating means 64 of the cylindrical extensions 60–63 comprises an annular recess 65 having a shallow annular groove 66 extending circumferentially thereabout. Similarly, each of the male mating means 59 includes a corresponding annular ridge 67 extending circumferentially thereabout and adapted to mate with the grooves 66. Therefore, through the agency of the male mating means 59 and female mating means 64 the cylindrical extensions 60–63 may be secured to the cylindrical portion 56 or to each other to provide a float 29 having a desired length.

As previously discussed, a bifurcated retainer clip 68 may be provided to allow for vertical pressure on valve 13 to to insure proper seating thereof when the apparatus 26 is used in association with a rigid stem type outlet valve. As best shown in FIG. 4, retainer clip 68 includes a circularly configured apex 69 seatable within any of the annular grooves 70, 71 of the cylindrical portion 56 of float 29. Extending outwardly from circular apex 69 are a pair of parallel arms 72 and 73 which are positionable for receiving therebetween a vertical member of the flush tank 10 for guiding the clip 68 upwardly and downwardly over valve 13. For example, in FIGS. 1 and 2, arm 22 of linkage means 14 is shown positioned between arms 72 and 73 of retainer clip 68.

From the foregoing, it will be appreciated that the water conserving apparatus 26 is a highly versatile piece of equipment having means for adapting its use to a wide variety of commode flush tanks. Among other features, the support plate 27 is adjustable in length to be securely wedgeable between variously spaced flush tank walls and the stem 28 and float 29 are independently adjustable in length to accommodate flush tanks of different vertical dimensions. Furthermore, the apparatus 26 is easily adjustable to vary the operating characteristics of any given flush tank. In this regard, it will be appreciated that the amount of flush water delivered by a given tank can be easily controlled by horizontally repositioning the position of the support plate 27 or, alternatively, by adjusting the length of float 29 by utilizing more or less of the cylindrical extensions.

Modifications may be made in the invention without departing from the spirit of it.

The embodiments of the invention in which an exclusive property or privilege is claimed are defined as follows:

1. In a commode flush tank of the type having a buoyant valve operable for opening and closing the flush water outlet of said tank, the improvement comprising:

a. an elongated stem member;

b. a plate member having adjustable means for wedging said plate member between two spaced and opposed walls of said tank, said plate further including means for carrying said stem extending downwardly into said tank at any one of a plurality of positions between said opposed walls; and c. an elongated float having a longitudinally disposed aperture extending therethrough and slidably receiving said stem, said float including contact means in association therewith, said stem being positioned relative to said plate to slidably maintain said float such that said float contact means is positioned generally over said buoyant valve, whereby upon partial emptying of said tank after flushing said float contact means contacts said buoyant valve to effect premature closure thereof.

2. The improvement according to claim 1 wherein said elongated float is adjustable in length for effecting premature closure of said buoyant valve at different predetermined levels of partial emptying of said tank.

3. The improvement according to claim 2 wherein said elongated float comprises a main portion having male mating means at one end therof, the other end of said float comprising said contact means, and at least one extension portion having male mating means at one end thereof, the other end of said float comprising said contact means, and at least one extension portion having female mating means at one end thereof matable with said male mating means of said main portion for securing said at least one extension portion thereto, said at least one extension portion having male mating means at its other end matable with the female mating means of similar extension portions.

4. The improvement according to claim 1 wherein said plate member comprises an adjusting bar having a plurality of centrally disposed apertures extending longitudinally thereof an at least one ratchet strip disposed on the top of said plate member, said ratchet strip comprising a plurality of transversely extending inclined teeth, said plate member further comprising a lock bar slidably associated with and at least partially overlying said adjusting bar and having at least one pawl at one end thereof disposed for engaging said inclined teeth of said ratchet strip for allowing relatively easy sliding displacement of said lock bar relative to said adjusting bar in one direction and relatively difficult sliding displacement in the opposite direction to facilitate wedging said plate member between said tank walls.

5. The improvement according to claim 4 wherein said elongated stem member comprises a structure slidably insertable in any one of said apertures of said adjusting bar, said elongated stem having a head portion at one end thereof, each of said apertures of said adjusting bar having means in association therewith for lockingly receiving said stem head portion.

6. The improvement according to claim 1 wherein said float contact means comprises a bifurcated structure carried by said float and having a pair of transversely extending arms disposed in parallel spaced relationship over said buoyant valve for exerting a uniform vertical pressure on said valve to effect premature closure thereof.

7. The improvement according to claim 6 wherein said float includes at least one annular groove extending circumferentially thereabout and wherein said bifurcated structure comprises an apex portion seatable within said at least one annular groove, said pair of arms extending transversely from said apex portion.

8. The improvement according to claim 4 wherein said lock bar includes an upstanding member between said pawls and overlying some of said centrally disposed apertures, said upstanding member having, at the end of said lock bar having said pawls, a projecting surface engageable by a tool inserted in one of said apertures to facilitate prying said lock bar relative to said adjusting bar.

9. The improvement according to claim 5 wherein sait stem member includes, near its end opposite said head portion, at least one annular groove extending circumferentially thereabout for defining a score line at which said stem is relatively easily breakable for altering the length thereof.

10. The improvement according to claim 1 including a pair of soft pads mountable at either end of said plate member and seatable against said tank walls to maintain said plate member firmly wedged therebetween and to compensate for any unevenness in the inside surfaces of said walls.

11. The improvement according to claim 10 wherein the surfaces of said soft pads seatable against said tank walls are characterized by a serrated structure.

* * * * *